US011885029B2

(12) United States Patent
Nazemi et al.

(10) Patent No.: US 11,885,029 B2
(45) Date of Patent: Jan. 30, 2024

(54) SYSTEMS AND METHODS FOR FORMING NITROGEN-BASED COMPOUNDS

(71) Applicant: Georgia Tech Research Corporation, Atlanta, GA (US)

(72) Inventors: Mohammadreza Nazemi, Atlanta, GA (US); Mostafa A. El-Sayed, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 759 days.

(21) Appl. No.: 16/788,656

(22) Filed: Feb. 12, 2020

(65) Prior Publication Data

US 2020/0255957 A1 Aug. 13, 2020

Related U.S. Application Data

(60) Provisional application No. 62/804,284, filed on Feb. 12, 2019.

(51) Int. Cl.
*C25B 1/00* (2021.01)
*C25B 15/08* (2006.01)
(Continued)

(52) U.S. Cl.
CPC ..... *C25B 1/00* (2013.01); *C25B 1/27* (2021.01); *C25B 9/65* (2021.01); *C25B 11/081* (2021.01); *C25B 15/02* (2013.01); *C25B 15/08* (2013.01)

(58) Field of Classification Search
CPC ..... C25B 1/00; C25B 1/27; C25B 11/081; C25B 1/04; C25B 1/55; C25B 3/21
See application file for complete search history.

(56) References Cited

U.S. PATENT DOCUMENTS 10,344,650 B2 7/2019 Skulason
10,458,028 B2 10/2019 Park et al.
(Continued)

FOREIGN PATENT DOCUMENTS

CN 106064097 A 11/2016
CN 109126786 A * 1/2019 ..... B01J 23/52
(Continued)

OTHER PUBLICATIONS

Nazemi et al. Enhancing the rate of electrochemical nitrogen reduction reaction for ammonia synthesis under ambient conditions using hollow gold nanocages. Nano Energy. Apr. 22, 2018. (Year: 2018).*

(Continued)

*Primary Examiner* — Harry D Wilkins, III
(74) *Attorney, Agent, or Firm* — Troutman Pepper Hamilton Sanders LLP; Ryan A. Schneider; Dustin B. Weeks

(57) ABSTRACT

An exemplary embodiment of the present invention provides a system for forming ammonia, the system comprising: an anode; a cathode in electrical communication with the anode; and a catalyst material positioned in an electrical communication pathway between the cathode and the anode, the catalyst material comprising a plurality of nanoparticles comprising at least one of a conductor and a semiconductor, each of the nanoparticles comprising an interior cavity, wherein the system is configured to use nitrogen and water to generate ammonia.

18 Claims, 8 Drawing Sheets

(51) Int. Cl.

| | |
|---|---|
| ***C25B 15/02*** | (2021.01) |
| ***C25B 9/65*** | (2021.01) |
| ***C25B 11/081*** | (2021.01) |
| ***C25B 1/27*** | (2021.01) |

(56) References Cited

U.S. PATENT DOCUMENTS

| | | | | |
|---|---|---|---|---|
| 10,843,172 | B2 | 11/2020 | Park et al. | |
| 2003/0164305 | A1* | 9/2003 | Denvir | C25B 1/27 205/552 |
| 2009/0095636 | A1* | 4/2009 | Botte | C25B 1/02 205/639 |
| 2012/0241328 | A1* | 9/2012 | Joshi | C25B 13/04 205/552 |
| 2013/0112568 | A1* | 5/2013 | Hikazudani | C25B 1/55 205/340 |
| 2016/0083853 | A1* | 3/2016 | Botte | C25B 9/19 205/338 |
| 2016/0138176 | A1* | 5/2016 | Yoo | C25B 9/19 204/239 |
| 2016/0194767 | A1* | 7/2016 | Mulder | C25B 11/04 205/552 |
| 2019/0092645 | A1* | 3/2019 | Kawasaki | C25B 1/00 |
| 2022/0002884 | A1 | 1/2022 | Katikaneni et al. | |

FOREIGN PATENT DOCUMENTS

| | | | | |
|---|---|---|---|---|
| CN | 114713839 | A | 5/2022 | |
| WO | WO 2016/172760 | A1 * | 11/2016 | C25B 1/55 |
| WO | 2022056427 | A1 | 3/2022 | |

OTHER PUBLICATIONS

Zhang et al. Seed-Mediated Synthesis of Au Nanocages and Their Electrocatalytic Activity towards Glucose Oxidation. Chemistry Europe. 2010, 16, 9248-9256. (Year: 2010).*

Schrauzer et al. Photolysis of Water and Photoreduction of Nitrogen on Titanium Dioxide. Feb. 15, 1977. (Year: 1977).*

Chadha et al. Gold nanocage coupled single crystal TiO2 nanostructures for near-infrared water photolysis. J Nanopart Res 16: 2696. Oct. 17, 2014. (Year: 2014).*

Guo et al., Hierarchical Cobalt Phosphide Hollow Nanocages toward Electrocatalytic Ammonia Synthesis under Ambient Pressure and Room Temperature, Small Methods, vol. 2, No. 12, Aug. 2018, 1800204, pp. 1-6 (Year: 2018).*

Guo et al., Supporting Information for Hierarchical Cobalt Phosphide Hollow Nanocages toward Electrocatalytic Ammonia Synthesis under Ambient Pressure and Room Temperature, Small Methods, vol. 2, No. 12, Aug. 2018, pp. 1-17 (Year: 2018).*

Li et al., Insights into the unique role of cobalt phosphide for boosting hydrogen evolution activity based on MIL-125-NH2, International Journal of Hydrogen Energy, vol. 44, No. 33, Jul. 2019, p. 17909-17921 (Year: 2019).*

* cited by examiner

SYSTEMS AND METHODS FOR FORMING NITROGEN-BASED COMPOUNDS

CROSS-REFERENCE TO RELATED APPLICATIONS

This application claims the benefit of U.S. Provisional Application Ser. No. 62/804,284, filed on 12 Feb. 2019, the entire contents and substance of which is incorporated herein by reference in its entirety as if fully set forth below.

STATEMENT OF RIGHTS UNDER FEDERALLY SPONSORED RESEARCH

This invention was made with government support under Contract Nos. 1608801 and 1904351 awarded by the National Science Foundation. The government has certain rights in the invention.

TECHNICAL FIELD OF THE INVENTION

The various embodiments of the present disclosure relate generally to systems and methods for forming nitrogen-based compounds.

BACKGROUND OF THE INVENTION

Ammonia is the second most produced chemical in the world. The global production of ammonia approached approximately 146 million metric tons in 2015 and is projected to rise by 40% in 2050. Ammonia-based fertilizers aid in increasing the food supply for the growing global population, expected to exceed approximately 10 billion by 2050. Ammonia also holds great promise as a carbon-neutral liquid fuel for storing intermittent renewable energy sources when supply exceeds demand in the grid, as well as for power generation due to the compound's high energy density and high hydrogen content. Ammonia can also play a major role in the development of a clean transportation sector and can be utilized directly in ammonia fuel cells or indirectly in hydrogen fuel cells. Using state-of-the-art carbon fiber storage tanks, it can take 700 bar pressure to achieve a volumetric energy density of 5.3 $GJ/m^3$ for hydrogen. With ammonia, liquefaction can be achieved under 10 bar pressure and can yield 13.6 $GJ/m^3$ energy density. Ammonia can be a superior energy carrier of hydrogen compared to other conventional fuels. For example, the hydrogen content in liquid ammonia is 17.6% by weight compared to 12.5% by weight for methanol. Thus, sustainable ammonia production lies at the nexus of food-energy chemistry.

The fixation of nitrogen to ammonia is a complex multi-step reaction, due to the high bonding energy of diatomic nitrogen. For instance, the nitrogen-nitrogen triple bond can have an energy of approximately 940.95 kJ/mol. Conventional ammonia synthesis processes are heavily dependent upon the Haber-Bosch process, which converts nitrogen and hydrogen to ammonia. These processes are energy-intensive, requiring greater than 600 kJ/mol ammonia produced, due to the high operating temperatures and pressures. In the Haber-Bosch process, all of the hydrogen gas is produced by the steam reformation of natural gas. This consumes 3-5% of the global natural gas supply and is responsible for 450 million metric tons of carbon dioxide emissions annually. This mandates an alternative approach for sustainable and scalable ammonia synthesis under ambient or near-ambient conditions that can alleviate extreme condition requirements.

Therefore, there is a desire for improved systems and methods for forming nitrogen-based compounds, such as ammonia. Various embodiments of the present invention address these desires.

BRIEF SUMMARY OF THE INVENTION

The present invention relates to systems and methods for forming nitrogen-based compounds.

An exemplary embodiment of the present invention provides a system for forming ammonia. The system can comprise: an anode, a cathode in electrical communication with the anode, and a catalyst material positioned in an electrical communication pathway between the cathode and the anode, the catalyst material comprising a plurality of nanoparticles comprising at least one of a conductor and a semiconductor, each of the nanoparticles comprising an interior cavity. The system can be configured to use nitrogen and water to generate ammonia.

In any of the embodiments disclosed herein, the catalyst material can be disposed on the cathode.

In any of the embodiments disclosed herein, the anode and the cathode can each comprise a substrate including a conductive material.

In any of the embodiments disclosed herein, the system can further comprise a voltage supply configured to supply a voltage across the anode and the cathode, the voltage generating an electron flow path in the electrical communication pathway.

In any of the embodiments disclosed herein, the system can further comprise an electrolyte configured to transport ions between the anode and the cathode.

In any of the embodiments disclosed herein, the system, when provided a nitrogen source, can have a yield of the ammonia of 1.5 $\mu g\text{-}h^{-1}\text{-}cm^{-2}$ or greater measured according to the equation:

$$\text{Yield} = \frac{(C)(V)(17\times10^6)}{(t)(A)}$$

wherein C is a concentration of the ammonia, V is a volume of the electrolyte, t is a time of reaction, and A is a surface area of the catalyst material.

In any of the embodiments disclosed herein, the system, when the voltage is from 0.2V to 0.8V, can have a Faradaic efficiency from 1% to 49% measured according to the equation:

$$Eff(\%) = (C)(V) \div \frac{(i)(t)}{(n)(F)}$$

wherein i is a current caused by the voltage, n is 3, F is the Faraday's constant, C is a concentration of the nitrogen compound, V is a volume of the electrolyte, and t is a time of reaction.

In any of the embodiments disclosed herein, the interior cavity of each of the plurality of nanoparticles can have a cross-sectional dimension from 5 nm to 100 nm.

Another embodiment can provide a method for forming ammonia, the method comprising: introducing nitrogen from a nitrogen source into a reactor, applying a voltage across the cathode and the anode, reacting, at one of the anode and the cathode, the nitrogen in the presence of the catalyst material and the voltage, and forming, in the reactor, the ammonia from the nitrogen. The reactor can comprise an anode, a cathode in electrical communication with the anode, and a catalyst material positioned in an electrical communication pathway between the cathode and the anode, the catalyst material comprising a plurality of nanoparticles comprising at least one of a conductor and a semiconductor, each of the nanoparticles comprising an interior cavity.

In any of the embodiments disclosed herein, the reactor can further comprise an electrolyte configured to transport ions between the anode and the cathode.

In any of the embodiments disclosed herein, the ammonia can have a yield compared to the nitrogen from the nitrogen source of 1.5 $\mu g\text{-}h^{-1}\text{-}cm^{-2}$ or greater measured according to the equation:

$$\text{Yield} = \frac{(C)(V)(17\times10^6)}{(t)(A)}$$

wherein C is a concentration of the ammonia, V is a volume of the electrolyte, t is a time of reaction, and A is a surface area of the catalyst material.

In any of the embodiments disclosed herein, the anode and the cathode can each comprise a substrate including a conductive material.

In any of the embodiments disclosed herein, the interior cavity can have a cross-sectional size from 5 nm to 50 nm.

In any of the embodiments disclosed herein, the reacting can comprise contacting the nitrogen with the catalyst material and reducing the nitrogen.

In any of the embodiments disclosed herein, the method can further comprise introducing water to the reactor.

Another embodiment can provide a system for forming ammonia, the system comprising: two or more electrodes, a nitrogen inlet, an electrolyte, a voltage supply configured to supply a voltage across the two or more electrodes in an electrical communication pathway, and a catalyst material positioned in the electrical communication pathway, the catalyst material comprising a plurality of nanoparticles comprising at least one of a conductor and a semiconductor, each of the nanoparticles comprising an interior cavity.

In any of the embodiments disclosed herein, the interior cavity can have a cross-sectional dimension from 5 nm to 50 nm.

In any of the embodiments disclosed herein, the catalyst material can be disposed on a substrate in communication with at least one of the two or more electrodes.

In any of the embodiments disclosed herein, the system, when provided a nitrogen source through the nitrogen inlet, can have a yield of the nitrogen compound of 1.5 $\mu g\text{-}h^{-1}\text{-}cm^{-2}$ or greater measured according to the equation:

$$\text{Yield} = \frac{(C)(V)(17\times10^6)}{(t)(A)}$$

wherein C is a concentration of the ammonia, V is a volume of the electrolyte, t is a time of reaction, and A is a surface area of the catalyst material.

In any of the embodiments disclosed herein, the system can be configured to receive nitrogen from the nitrogen inlet and generate the ammonia from the nitrogen.

These and other aspects of the present invention are described in the Detailed Description of the Invention below and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

BRIEF DESCRIPTION OF THE DRAWINGS

The accompanying drawings, which are incorporated in and constitute a part of this specification, illustrate multiple embodiments of the presently disclosed subject matter and serve to explain the principles of the presently disclosed subject matter. The drawings are not intended to limit the scope of the presently disclosed subject matter in any manner.

DETAILED DESCRIPTION OF THE INVENTION

Figure 1A:
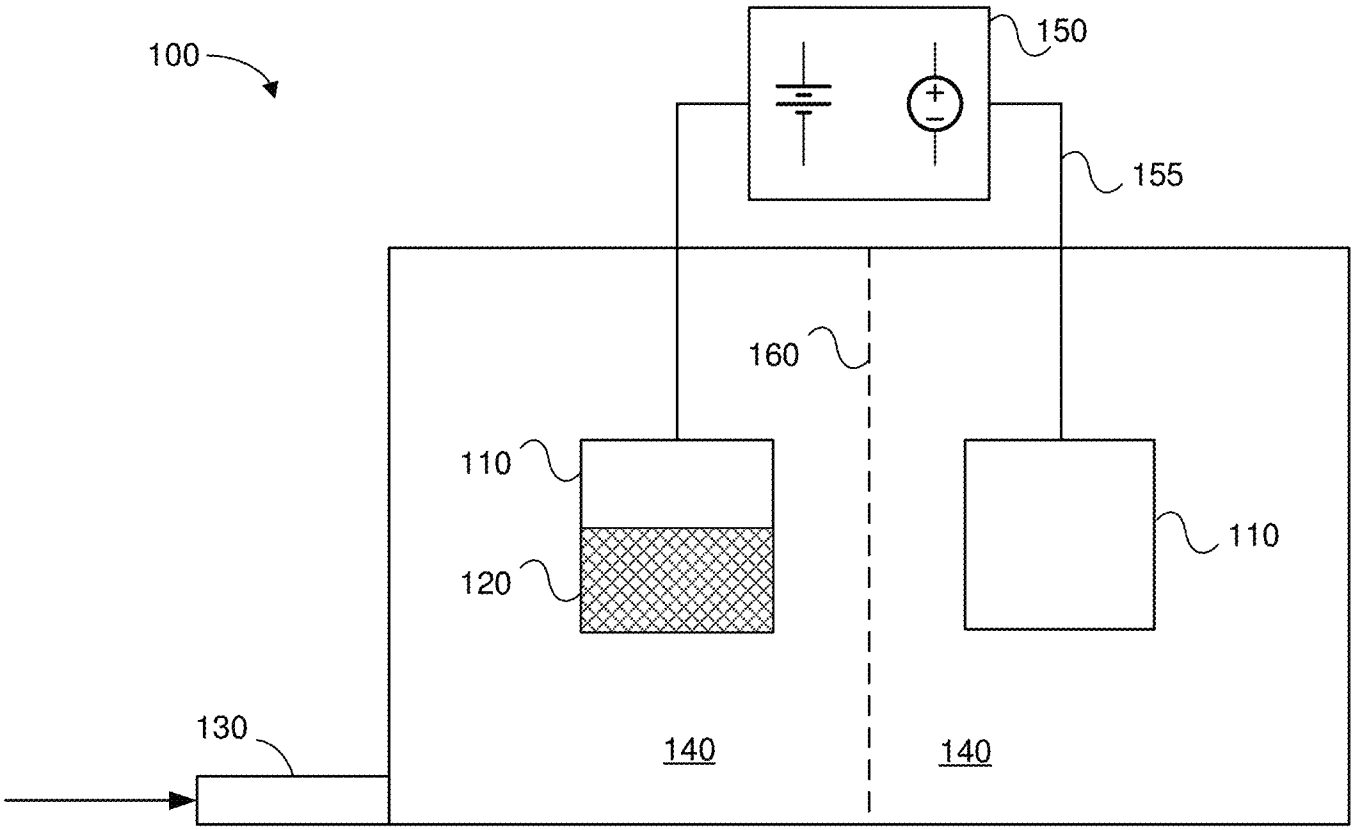
FIG. 1*a* illustrates a component diagram of a system for forming ammonia in accordance with example embodiments of the present disclosure.

Although certain embodiments of the disclosure are explained in detail, it is to be understood that other embodiments are contemplated. Accordingly, it is not intended that the disclosure is limited in its scope to the details of construction and arrangement of components set forth in the following description or illustrated in the drawings. Other embodiments of the disclosure are capable of being practiced or carried out in various ways. Also, in describing the embodiments, specific terminology will be resorted to for the sake of clarity. It is intended that each term contemplates its broadest meaning as understood by those skilled in the art and includes all technical equivalents which operate in a similar manner to accomplish a similar purpose.

Electrocatalytic fixation of nitrogen is a form of artificial synthesis that can mimic the natural nitrogen enzymatic process. The electrochemical Nitrogen Reduction Reaction (NRR) can enable the decentralized production of ammonia at ambient conditions from diatomic nitrogen, water, and electricity. The electricity can be provided through renewable energy sources, such as solar or wind, that are readily available from the environment. To date, few studies have been carried out to explore the fixation of nitrogen to ammonia using various electrocatalytic approaches. Unfortunately, in most of the known studies, the ammonia yield and Faradaic efficiency are too low to be practical for fertilizer production, mainly due to the stability of the diatomic nitrogen triple bond, and also due to intrinsic competition with the hydrogen evolution reaction. Furthermore, using molten salt systems and electrochemical lithium cycling strategy can result in higher ammonia yield and Faradaic efficiency; however, such strategies are not energetically efficient and require high temperatures. Developing an efficient heterogeneous electrocatalyst to increase the rate of ammonia production and improve the Faradaic efficiency through an energy efficient and environmentally friendly technique is vital in energy and agriculture-based industries.

Gold as an electrocatalyst can have greater performance for the electrochemical NRR. The NRR performed on gold surfaces can follow an associative mechanism in which the breaking of the triple bond of diatomic nitrogen and the hydrogenation of the free nitrogen atoms can occur simultaneously. Furthermore, the greater rate of the NRR on gold surfaces as opposed to surfaces of other electrocatalysts can be due to multifaceted gold surfaces, comprising various active sites for nitrogen adsorption and reduction. The selectivity of nitrogen molecules on the surface of nanocatalysts is a major challenge faced in improving the NRR. The rate of the electrochemical NRR can be enhanced under ambient conditions by increasing the surface area of the electrocatalyst. For instance, hollow gold nanocages can be used as an effective electrocatalyst. Using hollow gold nanocages, the highest ammonia yield and Faradaic efficiency can be achieved to be greater than any previous value obtained with known strategies in aqueous solution under ambient conditions (e.g., room temperature and atmospheric pressure). Similarly, concentrations of other gold-containing nano-compounds can be used, such as nanocubes, nanospheres, or nanorods to increase the surface area of the electrocatalyst material.

In nanocatalysis by solid nanoparticles, the catalytic reaction can occur by involving the atoms from the outer surface of the nanocatalyst. While using a hollow nanocatalyst, the reaction can occur both at the outer surface and the interior surface. Therefore, the reaction can be accelerated in the hollow nanocatalyst because it has a larger reactive surface area. Reactions in the cavity of the hollow nanocatalysts can be facilitated by the confinement of the reactants in the cavity, which can increase the steady-state concentration of the species in the rate-determining step of the reaction. Additionally, in some cases, the inner surface may not be as well-capped as the outer surface with a capping agent, and thus the inner surface can be more catalytically active. In such cases, the rate of the reaction can increase due to the confinement of the reactants inside the cavity.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

Unless stated otherwise herein, the term "nanoparticle" generally refers to a particle having at least one dimension that is no greater than 1000 nm, sometimes no greater than 500 nm, sometimes no greater than 100 nm, and sometimes no greater than 10 nm. Alternatively, or additionally, such particles can have at least one dimension that is no less than 1 nm, sometimes no less than 10 nm, sometimes no less than 100 nm, and sometimes no less than 500 nm. Alternatively, or additionally, such particles can have at least one dimension that is from 1 nm to 1000 nm. This can include, for example, "nanospheres," "nanorods," "nanocups," "nanowires," "nanoclusters," "nanolayers," "nanotubes," "nanocrystals," "nanobeads," "nanobelts," "nanomaterial," and "nanodisks."

As used herein, the term "nanoscale" refers to a dimension that is no greater than 500 nm, and sometimes no greater than 100 nm. The terms "nanoscale particle" and "nanoparticle" are used interchangeably in the present invention.

Reference will now be made in detail to exemplary embodiments of the disclosed technology, examples of which are illustrated in the accompanying drawings and disclosed herein. Wherever convenient, the same references numbers will be used throughout the drawings to refer to the same or like parts.

Figure 1B:
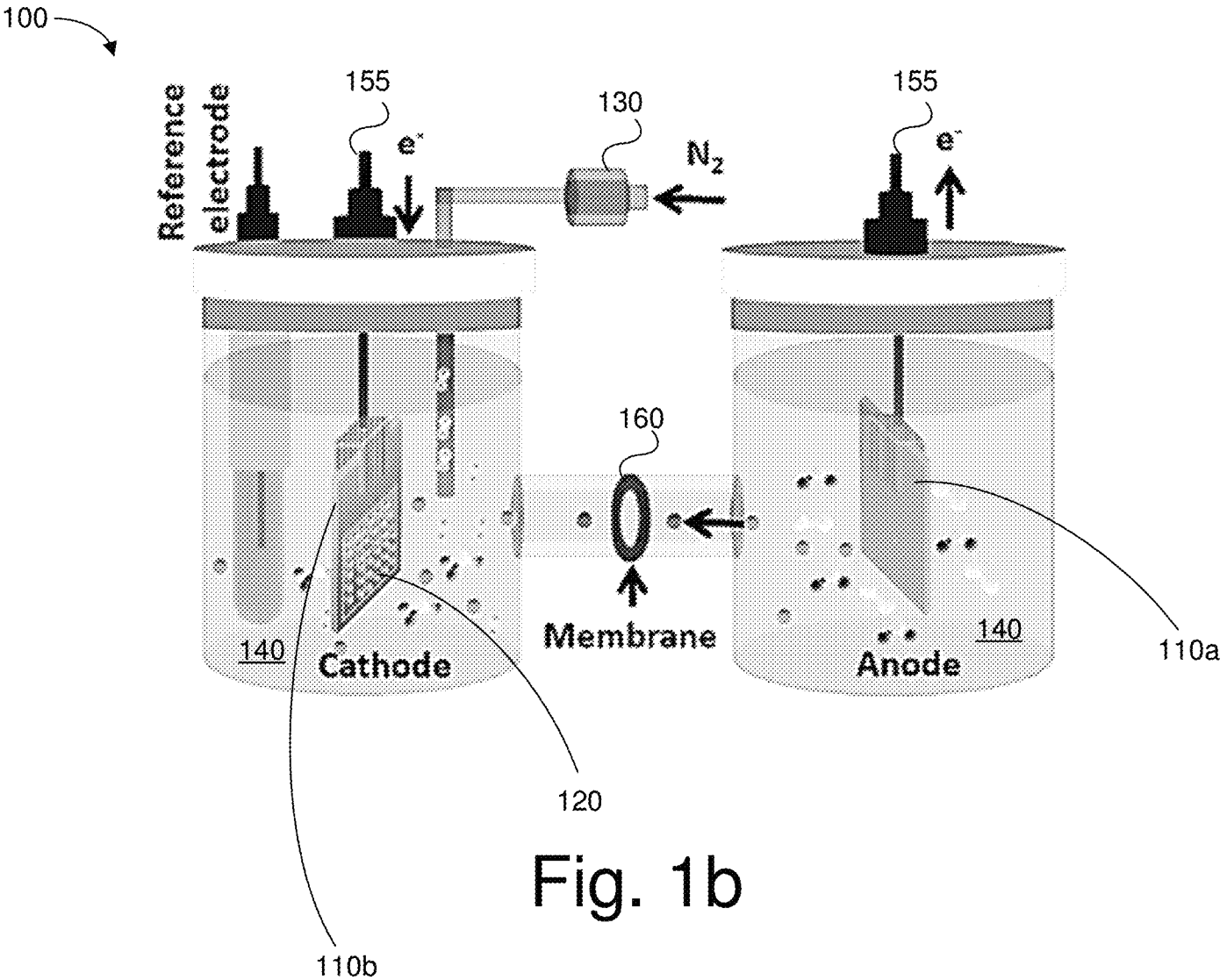
FIG. 1*b* illustrates another component diagram of a system for forming ammonia in accordance with example embodiments of the present disclosure.

As shown in FIGS. 1*a* and 1*b*, an exemplary embodiment of the present disclosure can provide a system for forming ammonia 100. The system can comprise two or more electrodes 110, such as an anode 110*a* and a cathode 110*b*, and a catalyst material 120. The catalyst material can be positioned in an electrical communication pathway between the two or more electrodes 110, such as between the cathode 110*b* and the anode 110*a*. The system 100 can additionally comprise a nitrogen inlet 130, an electrolyte 140, and a voltage supply 150. The voltage supply 150 can supply a voltage across the two or more electrodes 110.

The two or more electrodes 110 can comprise any conductor or semiconductor, such as a metal. Suitable examples of a metal can include, but are not limited to, graphite, silver, copper, gold, aluminum, calcium, tungsten, zinc, nickel, lithium, iron, platinum, tin, gallium, niobium, steel, carbon steel, lead, titanium, electrical steel, manganin, constantan, stainless steel, mercury, manganese, amorphous carbon, germanium and the like. The two or more electrodes 110 can be in the form of a mesh, a plate, a disc, and the like capable of providing a reactive surface. The two or more electrodes 110 can be configured to act as a substrate for the catalyst material 120. The two or more electrodes 100 can also be configured to contain the catalyst material 120 in any suitable manner.

The catalyst material 120 can be disposed on one of the two or more electrodes 110, such as on the cathode 110*b*. Suitable examples of a catalyst material can include conductive materials, such as graphite, silver, copper, gold, palladium, iridium, rhodium, ruthenium, cobalt, aluminum, calcium, tungsten, zinc, nickel, lithium, iron, platinum, tin, gallium, niobium, steel, carbon steel, lead, titanium, electrical steel, manganin, constantan, stainless steel, mercury, manganese, amorphous carbon, germanium and the like.

The catalyst material 120 can also comprise semi-conductive materials, such as titanium oxides, cuprous oxide, copper oxide, tin oxides, silicon, silicon oxides, zirconium oxides, molybdenum oxides, manganese oxides, iron oxides, and the like. Additionally, the catalyst material 120 can comprise such materials as rhenium oxide, tantalum oxide, osmium oxide, iridium oxide, vanadium oxide, niobium oxide, ruthenium oxide, platinum oxide, rhodium oxide, chromium oxide, titanium oxide and manganese oxide (among the others already mentioned). Alternatively, the catalyst material 120 can comprise oxides, carbides, nitrides, phosphates, phosphides, borides, and other transition-metal compounds formed from rhenium, tantalum, osmium, iridium, vanadium, niobium, ruthenium, platinum, rhodium, chromium, titanium, manganese, molybdenum, zirconium, tin, or other metals.

The catalyst material 120 can comprise a plurality of nanoparticles. The plurality of nanoparticles can include nano-cages or other nano-compounds, such as nano-cubes, nanospheres, nano-rods, or any combinations thereof to increase the surface area of the catalyst material 120. Each of the nanoparticles used in the catalyst material can comprise an interior cavity. For example, the catalyst material 120 can comprise hollow gold nano-cages having an interior cage cavity. As would be appreciated, the inclusion of an interior cavity can greatly increase the surface area of the catalyst material 120, and therefore, the rate of reaction.

As used herein, the term "cross-sectional dimension" refers to the size of an object along a cross-sectional plane intersecting the longest dimension of said object (e.g., the diameter of a sphere, the length of a cylinder). For any selected plurality of nanoparticles in the catalyst material 120, the interior cavity of each of the plurality of nanoparticles can have a cross-sectional dimension from 5 nm to 100 nm (e.g., from 5 nm to 95 nm, from 5 nm to 90 nm, from 5 nm to 85 nm, from 5 nm to 80 nm, from 5 nm to 75 nm, from 5 nm to 70 nm, from 5 nm to 65 nm, from 5 nm to 60 nm, from 5 nm to 55 nm, from 5 nm to 50 nm, from 10 nm to 90 nm, from 15 nm to 85 nm, from 20 nm to 80 nm, from 25 nm to 75 nm, from 30 nm to 70 nm, from 35 nm to 65 nm, from 40 nm to 60 nm, or from 45 nm to 55 nm).

The electrolyte 140 can be contained within the system. For example, the electrolyte may be contained between the anode 110*a* and the cathode 110*b*. The electrolyte can be capable of transporting ions between the two or more electrodes 110. The electrolyte can be a solid electrolyte, an aqueous electrolyte, or a non-aqueous electrolyte. Suitable examples of an aqueous electrolyte can include, but are not limited to, alkaline solutions and acidic solutions, such as lithium perchlorate or potassium perchlorate. Suitable examples of a solid electrolyte can include, but are not limited to, polymers and ceramics. Other examples of an electrolyte can include, but are not limited to, lithium perchlorate, sodium chloride, lithium phosphate, potassium hydroxide, and the like. Suitable examples of a non-aqueous electrolyte can include, but are not limited to, organic-based electrolytes, such as tetrahydrofuran, alcohol, or glycerol. The system 100 can further comprise a membrane 160 to separate the anode 110*a* from the cathode 110*b* while allowing the ions in the electrolyte 140 to pass through.

The electrolyte 140 can be utilized by the electrical communication pathway to operate an electrochemical reaction. The system 100 can utilize the voltage supply 150 to supply a voltage across the two or more electrodes 110. To complete the circuit, the system 100 can further comprise external circuitry 155 to connect the two or more electrodes 110. The voltage can generate an electron flow path in the electrical communication pathway, and the external circuitry 155 can complete a circuit with the electrical communication pathway. The electrical communication pathway can flow through the electrolyte 140, and also allow ions to be exchanged between the two or more electrodes 110.

Figure 2:
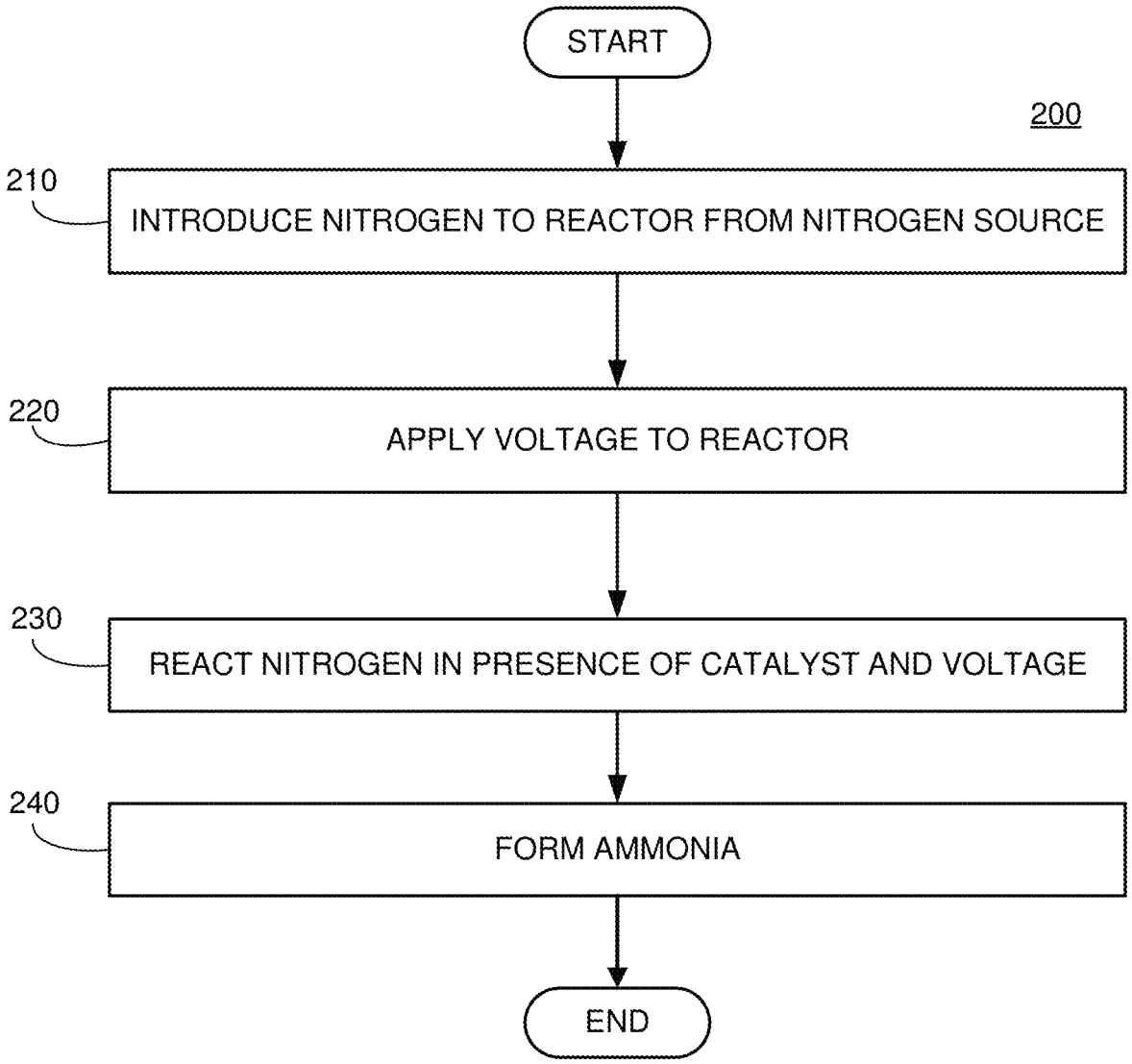
FIG. 2 illustrates a flowchart of a method for forming ammonia in accordance with example embodiments of the present disclosure.

FIG. 2 illustrates a flowchart of an exemplary method 200 for forming ammonia. As shown in block 210, nitrogen from a nitrogen source can be introduced to a reactor. The nitrogen source can be, for example, air. Other nitrogen sources can be used, such as pure nitrogen. The reactor can have the structure of the system 100 described above. Water can also be added as a reactant to the reactor to facilitate the reaction.

Figure 3:
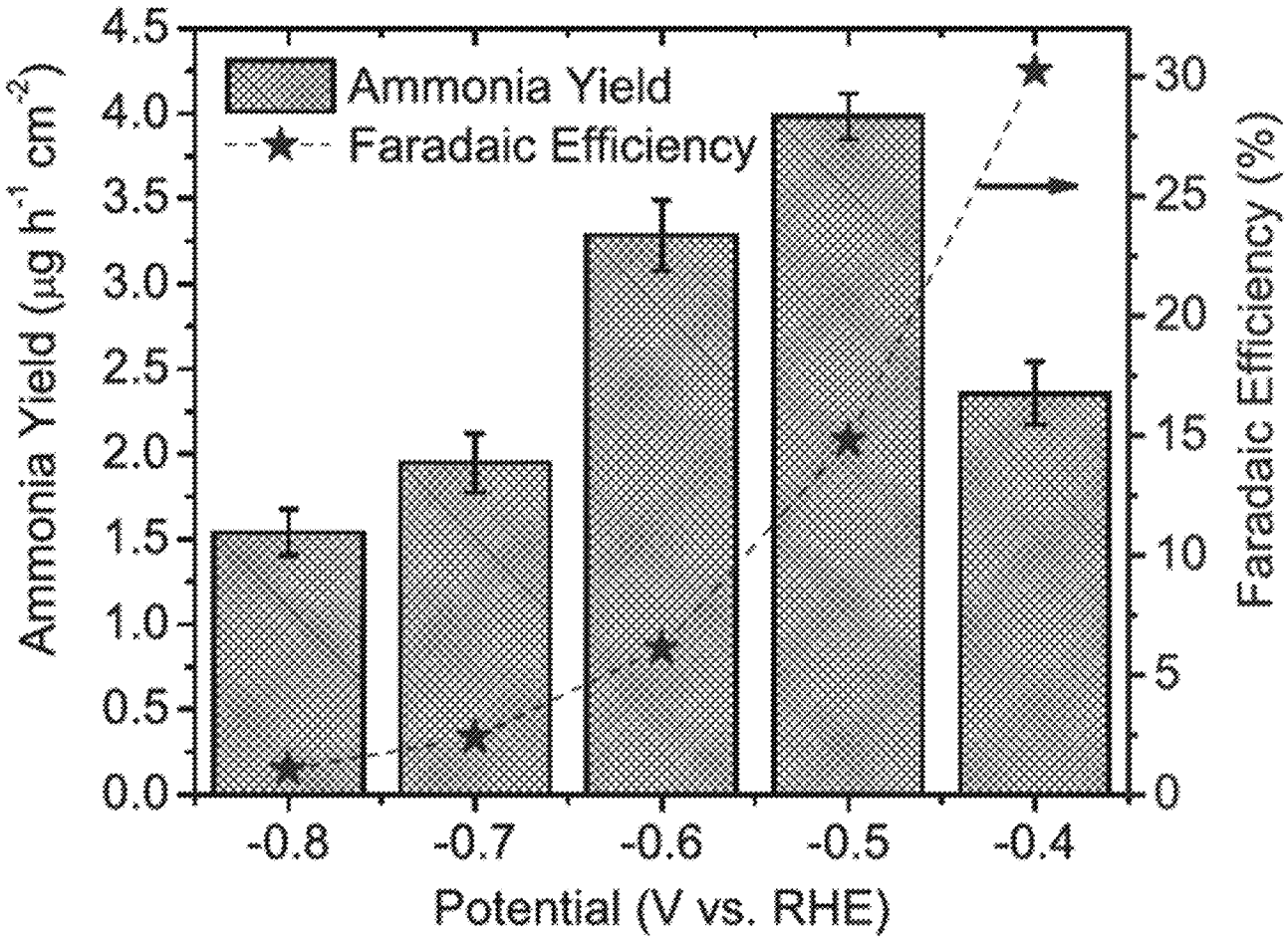
FIG. 3 is a chart illustrating the ammonia yield and Faradaic efficiency of various example embodiments of the present disclosure.

In block 220, a voltage can be applied across the cathode 110*b* and the anode 110*b* by the voltage supply 150. The voltage applied can be from 0.1 V to 1 V (e.g., from 0.1 V to 0.9 V, from 0.1 V to 0.8 V, from 0.1 V to 0.7 V, from 0.1 V to 0.6 V, from 0.1 V to 0.5 V, from 0.1 V to 0.4 V, from 0.1 V to 0.3 V, from 0.1 V to 0.2 V, from 0.2 V to 0.8 V, from 0.3 V to 0.8 V, from 0.4 V to 0.8 V, from 0.4 V to 0.7 V, or from 0.4 V to 0.6 V). The voltage can be applied by the voltage supply 150 and cause an electron flow through an electrical communication pathway between the cathode 110*b* and the anode 110*a*. The external circuitry 155 can complete a circuit with the electrical communication pathway, with the electrolyte 140 completing the circuit between the cathode 110*b* and the anode 110*a*. Various Faradaic efficiencies and ammonia yields for various examples of applied voltages can be seen in FIG. 3.

When the method 200 is applying the voltage to the system 100, the system 100 can achieve a Faradaic efficiency. The Faradaic efficiency of the system 100 achieved by the method 200 can be calculated by the following equation:

$$Eff(\%) = (C)(V) \div \frac{(i)(t)}{(n)(F)}$$

wherein i is a current caused by the voltage, n is 3, F is the Faraday's constant, C is a concentration of ammonia, V is a volume of the electrolyte 140, and t is a time of reaction.

Figure 4:
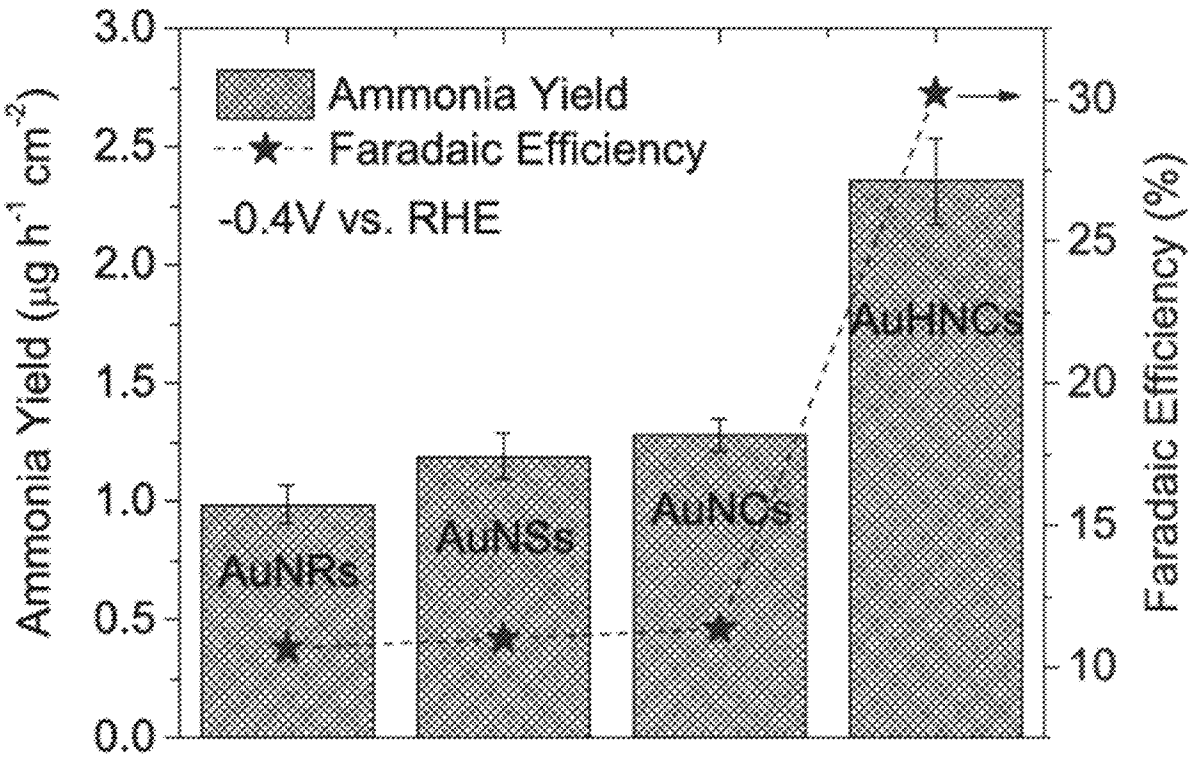
FIG. 4 is another chart illustrating the ammonia yield and Faradaic efficiency of various example embodiments of the present disclosure.

The Faradaic efficiency of the disclosed method 200 can be from 1% to 100% (e.g., from 1% to 90%, from 1% to 80%, from 1% to 70%, from 1% to 60%, from 1% to 50%, from 1% to 49%, from 1% to 45%, from 1% to 40%, from 1% to 35%, from 1% to 30%, or from 1% to 25%). Various Faradaic efficiencies for various examples of nanoparticles used in the catalyst material 120 can be seen in FIG. 4.

In block 230, the reaction can occur at one of the two or more electrodes 110, such as at the cathode 110*b*. The nitrogen from the nitrogen source can be reacted in the presence of the catalyst material 120 and the voltage. As described above, the reaction can form ammonia at a much greater rate than previous systems due to the catalyst material 120 having a greater surface area and interior cavities. For example, the catalyst material 120 can comprise hollow gold nano-cages. The reaction can include the Nitrogen Reduction Reaction (NRR) to form ammonia. During the reaction, minimal additional energy can be added in the form of temperature and pressure.

In some examples, the reaction can occur at ambient temperature and pressure (e.g., 1 atmosphere and room temperature). The temperature of the reaction can be from 20° C. to 50° C. (e.g., from 20° C. to 45° C., from 20° C. to 40° C., from 20° C. to 35° C., from 20° C. to 30° C., or from 25° C. to 35° C.).

In block 240, the method 200 can form ammonia in the reactor as a product of the reaction from the nitrogen source. The method 200 can achieve an ammonia yield. The ammonia yield of the method 200 can be calculated by the following equation:

$$\text{Yield} = \frac{(C)(V)(17\times10^{6})}{(t)(A)}$$

wherein C is a concentration of the ammonia, V is a volume of the electrolyte 140, t is a time of reaction, and A is a surface area of the catalyst material 120.

The ammonia yield of the method 200 can be 1.5 $\mu g\text{-}h^{-1}\text{-}cm^{-2}$ or greater. The ammonia yield of the method 200 can be 64 $\mu g\text{-}h^{-1}\text{-}cm^{-2}$ or less. The ammonia yield of the method 200 can be from 1.5 $\mu g\text{-}h^{-1}\text{-}cm^{-2}$ to 64 $\mu g\text{-}h^{-1}\text{-}cm^{-2}$. Various ammonia yields for various examples of nanoparticles used in the catalyst material 120 can be seen in FIG. 4.

Figure 5:
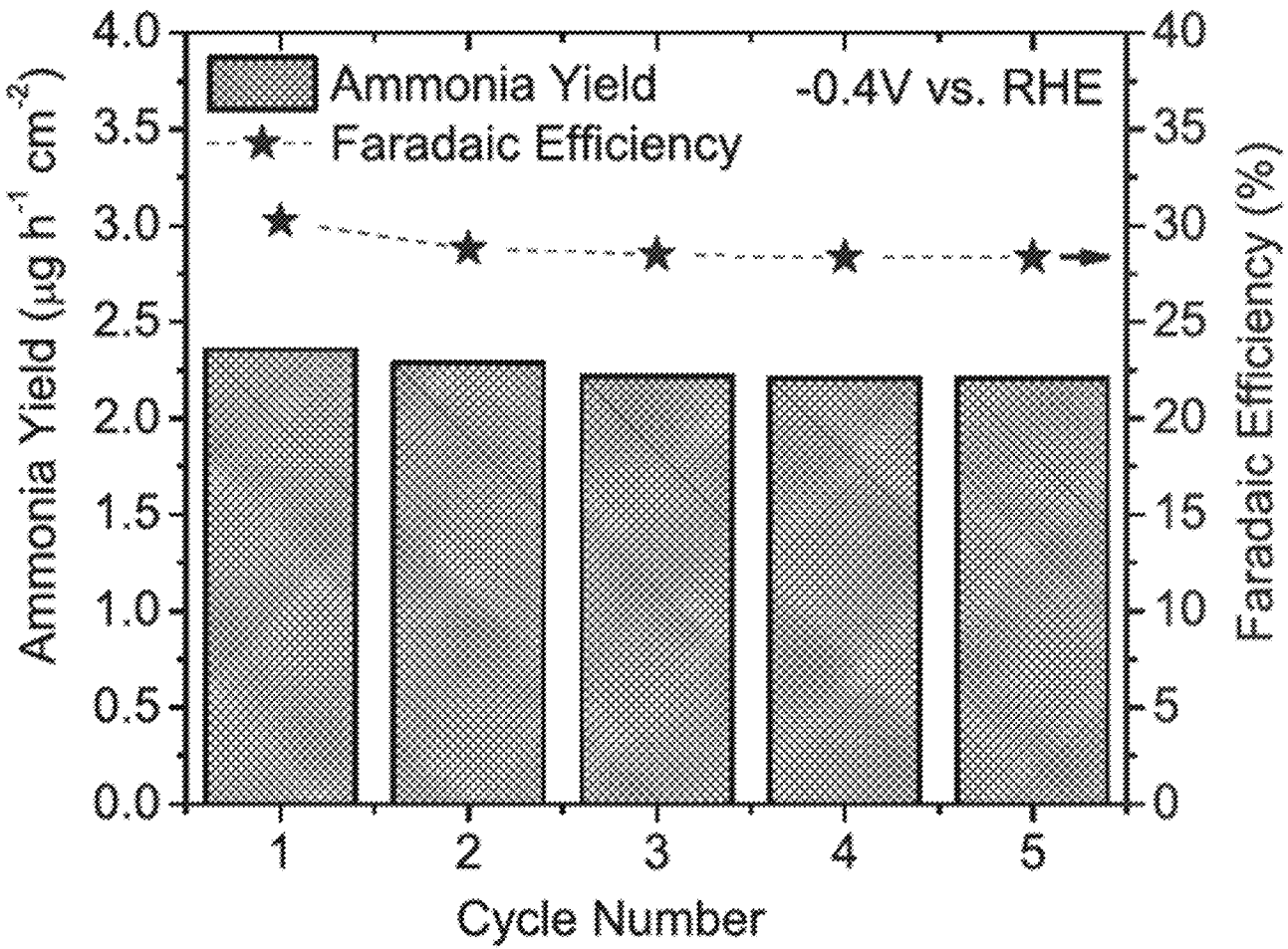
FIG. 5 is another chart illustrating the ammonia yield and Faradaic efficiency of various example embodiments of the present disclosure.

In some embodiments, the method 200 may terminate and complete after block 240. However, in other embodiments, the method may continue on to other method steps not shown. Alternatively, the method 200 can repeat and perform numerous cycles of the reaction. An example of the ammonia yield and Faradaic efficiency over time is shown as the number of cycles increases in FIG. 5.

Certain embodiments and implementations of the disclosed technology are described above with reference to block and flow diagrams of systems and methods according to example embodiments or implementations of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams may not necessarily need to be performed in the order presented, may be repeated, or may not necessarily need to be performed at all, according to some embodiments or implementations of the disclosed technology.

Exemplary Use Cases

The following examples are provided by way of illustration but not by way of limitation.

Hollow gold nanoparticles with cubic shape can be prepared by a galvanic replacement method using cubic silver nanoparticles as a template. Silver nano-cubes (AgNCs) can be prepared by a modified polyol reduction of $AgNO_3$. In a 100 mL round-bottomed flask, 35 mL of anhydrous ethylene glycol (EG) can be stirred at 400 rpm and heated at 150° C. for 1 h in an oil bath. After 1 h heating of the EG, 0.35 g of poly-vinylpyrrolidone (PVP, MW—55000) dissolved in 5 mL EG can be added to the reaction mixture. The temperature of the reaction mixture can then be increased gradually until it reaches 155° C. At this temperature, 0.4 mL of 3 mM solution of sodium sulfide (Na2S·9H2O) in EG can be added 5 min after the addition of PVP. The solution of sodium sulfide can be prepared an hour before injection into the reaction mixture. Finally, 0.25 g of $AgNO_3$ dissolved in 5 mL of EG can be added with stirring set to 200 rpm until the color changes from brownish yellow to pale yellow. Then the stirring and heating can be stopped, and the solution temperature can be allowed to decrease to room temperature. To clean the AgNCs solution from the byproducts, extra PVP, and organic solvents, 20 mL of the AgNCs solution can be diluted with 20 mL of acetone and centrifuged for 10 min at 10,000 rpm. The precipitated AgNCs can be dispersed in the solution of 0.01 g PVP dissolved in 100 mL of DI water.

To prepare hollow gold nano-cages (AuHNCs), the cleaned AgNCs solution in DI water can be heated and brought to boiling. Then, $HAuCl_4$ (0.2 g $L^{-1}$) in DI water can be injected to the AgNC solution under vigorous stirring (600 rpm) until the peak LSPR spectrum of the solution shifts to 660 nm. The solution can be refluxed for 2 min with stirring until the LSPR remains fixed. The solution can be cooled down and centrifuged at 10,000 rpm for 10 min. The precipitated nanoparticles can be dispersed in DI water for future use.

AuNSs can be prepared by the reduction of $HAuCl_4{\cdot}3H_2O$ using PVP (MW—10,000) that acts as both a capping and a reducing agent. In a 150 mL flask, 100 mL of 0.085 mM $HAuCl_4$ in DI water can be heated and brought to boiling. Under 500 rpm stirring, 0.65 g PVP can be added. The reaction can be allowed to proceed until the solution turns to red color and the LSPR peak becomes narrow. The solution can be cooled down and centrifuged at 10,000 rpm for 10 min. The precipitated nanoparticles can be dispersed in DI water for future use.

AuNCs can be prepared using a modified surfactant-directed seed-mediated approach. The seed particles can be prepared using 7.75 mL of solution containing 7.50 mL of 0.1 M cetyltrimethylammonium bromide (CTAB) and 0.25 mL of 0.01 M $HAuCl_4$ in DI water. Next, 0.6 mL of an ice cold 0.01 M $NaBH_4$ solution can be added to the initial solution for the subsequent reduction of gold ions. The resulting solution can be stirred for 2 min and can remain undisturbed for an hour before use. The seed solution can then be diluted 10 times with DI water. To prepare the growth solution, 4 mL of DI water, 0.8 mL of 0.1 M CTAB, and 0.1 mL of 0.01 M $HAuCl_4$ can be mixed thoroughly. A 0.6 mL of 0.1 M ascorbic acid can be added to the growth solution and mixed thoroughly until the solution turns colorless. Finally, 2.5 μL of the diluted seed solution can be added to the growth solution and the reaction vessel can be allowed to sit overnight. The AuNCs can be centrifuged two times at 10,000 rpm for 10 min. The precipitated AuNCs can be dispersed in DI water for future use.

AuNRs can be synthesized by a modified seed-mediated protocol. Briefly, the seed nanoparticles can be prepared by adding 0.25 mL of $HAuCl_4$ (0.01 M) to 7 mL of CTAB (0.1 M) followed by the addition of 0.01 M of ice-cold $NaBH_4$ (0.6 mL) solution in DI water. This solution can be stirred for 2 min and left undisturbed for 1 h. In the subsequent step, 1 mL of seed solution can be added to the growth solution, which can be prepared by mixing 100 mL of CTAB (0.1 M) with 4.25 mL of $HAuCl_4$ (0.01 M), 0.625 mL of $AgNO_3$ (0.01 M), and 0.675 mL of ascorbic acid (0.1 M). After the addition of the seed solution, the entire solution can be kept undisturbed for 12 h. The resultant AuNRs can be purified by centrifugation (10,000 rpm for 10 min) and redispersed in DI water.

Figure 6:
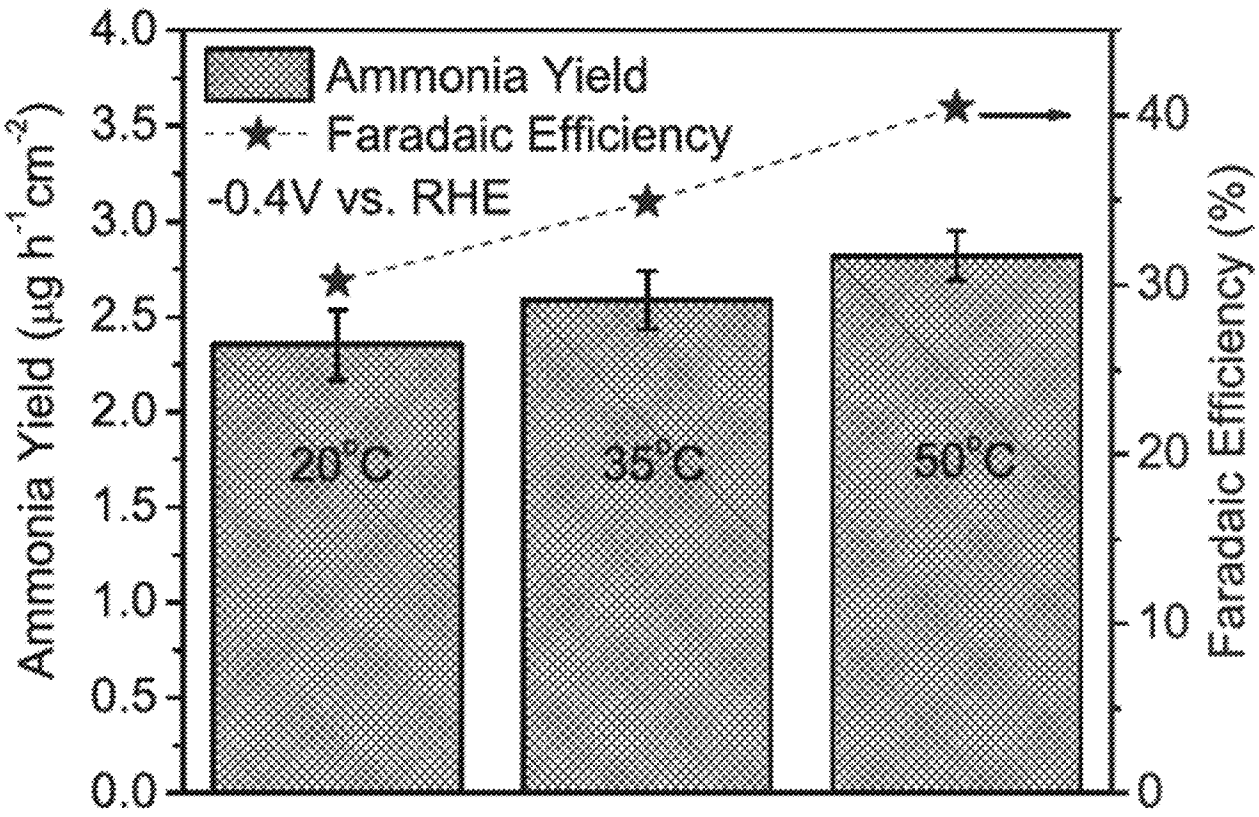
FIG. 6 is another chart illustrating the ammonia yield and Faradaic efficiency of various example embodiments of the present disclosure.

In order to prepare a working electrode (cathode), 300 μL of nanoparticles of known concentration and 1.5 μL of NAFION® solution (5% wt.) can be sonicated and dropped onto an indium tin oxide (ITO) (1 cm×1 cm) and then dried under $N_2$ atmosphere at 75° C. for 45 min. Electrochemical measurements can be carried out at 20° C., 35° C., and 50° C. (as shown in FIG. 6.) in the water bath in 0.5 M $LiClO_4$ electrolyte (40 mL, each side) using a CHI instrument potentiostat (CHI, 700 D) in the three-electrode setup. Platinum mesh (1 cm×1 cm) and a Ag/AgCl reference electrode (3 M, BASi, USA) can be used as counter and reference electrodes. A cation exchange membrane can be used to separate the anodic and cathodic compartments while protons produced at the anode can transport across the membrane to the cathode side where the NRR occurs.

The measured potentials vs. Ag/AgCl can be iR-compensated and converted to the reversible hydrogen electrode (RHE) scale based on the following equation:

$$E_{RHE} = E_{Ag/AgCl} + \frac{2.3\,RT}{F}PH + E^{o}_{Ag/AgCl}$$

where $E_{RHE}$ is the converted potential vs. RHE, $E^{0}_{Ag/AgCl}$= 0.2027 at 20° C. with the slope of −1.01 mV/° C., $E_{Ag/AgCl}$ is the experimentally measured potential against Ag/AgCl reference electrode, R is the gas constant (8.314 J $mol^{-1}$ $K^{-1}$), and T is the operating temperature (K).

Figure 7:
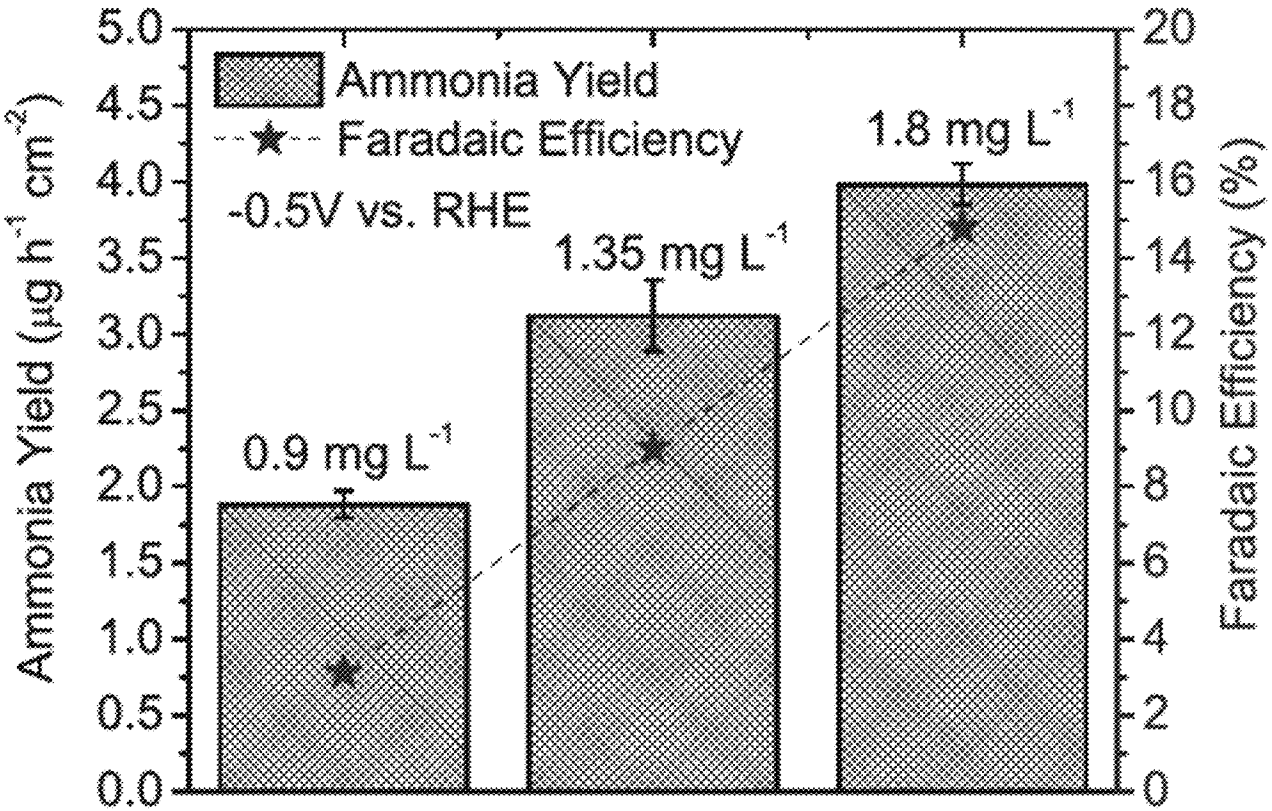
FIG. 7 is another chart illustrating the ammonia yield and Faradaic efficiency of various example embodiments of the present disclosure.

The electrolyte can be fed with $N_2$ or Ar gas for 2 h before starting the measurement at the flow rate of 20 mL $min^{-1}$. It is also shown that increasing the concentration of the nanoparticles in the catalyst (AuHNCs, for example) can have a positive effect on both ammonia yield and Faradaic efficiency, as shown in FIG. 7.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. Instead, it is intended that the invention is defined by the claims appended hereto.

What is claimed is:

1. A system comprising:

an anode configured for an anodic reaction;

a cathode configured for a cathodic reaction, the cathode independent from the anode while in electrical communication with the anode;

an ion exchange membrane separating the anode and the cathode; and a catalyst material comprising hollow gold nano-cages (AuHNCs) disposed on the cathode;

wherein a nitrogen reduction reaction (NRR) occurs at the catalyst material disposed on the cathode to form a nitrogen-based compound.

2. The system of claim 1 further comprising a voltage supply configured to supply voltage across the anode and the cathode;

wherein the catalyst material comprises photoresponsive catalyst material; and wherein the system is configured to combine electrochemistry with photochemistry, as exposure of the catalyst material to incident light generates photovoltage and photocurrent for the system.

3. The system of claim 1, wherein the system is capable of using gaseous reactants to produce the nitrogen-based compound; and wherein the system is capable of using liquid reactants to produce the nitrogen-based compound.

4. A method for forming ammonia comprising:

introducing nitrogen from a nitrogen source into a reactor comprising the system of claim 1;

applying a voltage across the cathode and the anode;

reacting, at the cathode, the nitrogen in the presence of the catalyst material and the voltage; and forming, in the reactor, the ammonia from the nitrogen.

5. The method of claim 4 further comprising transporting ions between the anode and the cathode with an electrolyte.

6. The method of claim 5, wherein the forming comprises yielding the ammonia at 1.5 μg-$h^{-1}$-$cm^{-2}$ or greater measured according to the equation:

$$\text{Yield} = \frac{(C)(V)(17\times10^{6})}{(t)(A)}$$

wherein:

C is a concentration of the ammonia;

V is a volume of the electrolyte;

t is a time of reaction; and

A is a surface area of the catalyst material.

7. The method of claim 6, wherein the anode and the cathode each comprise a substrate including a conductive material.

8. The method of claim 6, wherein an interior cavity of at least a portion of the hollow AuHNCs has a cross-sectional dimension from 5 nm to 100 nm.

9. The method of claim 6, wherein the reacting comprises: contacting the nitrogen with the catalyst material; and reducing the nitrogen.

10. The method of claim 6 further comprising introducing water to the reactor.

11. The method of claim 6 further comprising operating the method under ambient conditions.

12. A system comprising:

an anode configured for an anodic reaction;

a cathode configured for a cathodic reaction, the cathode independent from the anode while in electrical communication with the anode;

an ion exchange membrane separating the anode and the cathode;

a catalyst material comprising hollow nanoparticles disposed on the cathode;

a voltage supply configured to supply from 0.1 V to 1 V across the anode and the cathode;

a nitrogen source; and an electrolyte selected from the group consisting of a non-aqueous electrolyte and a solid electrolyte configured to transport ions between the anode and the cathode;

wherein protons produced at the anode transport across the ion exchange membrane to the cathode where a nitrogen reduction reaction (NRR) occurs at the catalyst material disposed on the cathode to form a nitrogen-based compound;

wherein the catalyst material comprises a combination of semiconductor nanoparticles and hollow gold nanocages (AuHNCs); and wherein an interior cavity of at least a portion of the nanoparticles has a cross-sectional dimension from 5 nm to 100 nm, the nanoparticles selected from the group consisting of the semiconductor nanoparticles, the AuHNCs, and a combination thereof.

13. The system of claim 12, wherein the system has a yield of ammonia of 1.5 $\mu g\text{-}h^{-1}\text{-}cm^{-2}$ or greater measured according to the equation:

$$\text{Yield} = \frac{(C)(V)(17\times10^6)}{(t)(A)}$$

wherein:

C is a concentration of the ammonia;

V is a volume of the electrolyte;

t is a time of reaction; and

A is a surface area of the catalyst material.

14. The system of claim 12, wherein the system, when the voltage is from 0.2V to 0.8 V, has a Faradaic efficiency from 1% to 49% measured according to the equation:

$$Eff(\%) = (C)(V) \div \frac{(i)(t)}{(n)(F)}$$

wherein:

i is a current caused by the voltage;

n is 3;

F is the Faraday's constant;

C is a concentration of the ammonia;

V is a volume of the electrolyte; and t is a time of reaction.

15. A system for forming ammonia comprising:

two or more electrodes, each being independent and separate one from another;

a nitrogen inlet;

an electrolyte selected from the group consisting of a non-aqueous electrolyte and a solid electrolyte;

a voltage supply configured to supply from 0.1 V to 1 V across the electrodes in an electrical communication pathway; and a catalyst material of hollow cold nano-canes (AuHNCs) disposed on at least one cathode of the two or more electrodes;

wherein the system, when provided a nitrogen source through the nitrogen inlet, has a yield of ammonia of 1.5 $\mu g\text{-}h^{-1}\text{-}cm^{-2}$ or greater measured according to the equation:

$$\text{Yield} = \frac{(C)(V)(17\times10^6)}{(t)(A)}$$

wherein:

C is a concentration of the ammonia;

V is a volume of the electrolyte;

t is a time of reaction; and

A is a surface area of the catalyst material.

16. The system of claim 15, wherein at least a portion of the hollow AuHNCs have an interior cavity having a cross-sectional dimension from 5 nm to 50 nm.

17. The system of claim 16, wherein the catalyst material is disposed on a substrate in communication with at least one of the electrodes.

18. The system of claim 15, wherein the system is capable of using gaseous reactants to produce the ammonia; and wherein the system is capable of using liquid reactants to produce the ammonia.

* * * * *